US005257587A

United States Patent [19]

Ohlsen et al.

[11] Patent Number: 5,257,587

[45] Date of Patent: Nov. 2, 1993

[54] METHOD AND APPARATUS FOR INTRODUCING AND INCINERATING SOLID COMBUSTIBLE WASTE IN A ROTARY KILN

[75] Inventors: Ib Ohlsen; Hans H. Hartington, both of Valby, Denmark

[73] Assignee: F.L. Smidth & Co. A/S, Denmark

[21] Appl. No.: 893,664

[22] Filed: Jun. 5, 1992

[51] Int. Cl.[5] ..... F23G 5/00

[52] U.S. Cl. ..... 110/346; 110/101 R; 110/226; 110/246; 110/257

[58] Field of Search ..... 110/346, 246, 226, 101 R, 110/109, 255, 257; 414/149

[56] References Cited

U.S. PATENT DOCUMENTS 4,303,477 12/1981 Schmidt et al. ..... 110/246 X
4,315,712 2/1982 Seglias ..... 110/246 X
4,969,407 11/1990 Benoit et al. ..... 110/346

*Primary Examiner*—Edward G. Favors
*Attorney, Agent, or Firm*—Brumbaugh, Graves, Donohue & Raymond

[57] ABSTRACT

For incineration of solid combustible waste a method is described according to which the waste is introduced into and incinerated in the outlet casing of a rotary kiln when brought into contact with the hot airstream flowing through the kiln. Hence a simple and cheap method for incinerating waste is obtained, since the waste is introduced through a stationary wall.

18 Claims, 2 Drawing Sheets

METHOD AND APPARATUS FOR INTRODUCING AND INCINERATING SOLID COMBUSTIBLE WASTE IN A ROTARY KILN

BACKGROUND OF THE INVENTION

The invention relates to a method for introducing and incinerating solid combustible waste, such as automobile tires, in a rotary kiln. Furthermore, the invention relates to an apparatus for carrying out the method.

It has proven to be advantageous both from an economic and environmental viewpoint to dispose of various types of combustible waste by incineration in a rotary kiln, for example for cement production, in combination firing with the normal fuel. If the waste is liquid, gaseous or pulverulent, the waste can normally be incinerated by using known burner equipment. However, if the waste is in solid form, with its lump size being such that the single lumps cannot be conveyed through the kiln by means of the gas stream, specialized methods are needed to inject the waste sufficiently far into the rotary part of the kiln so that complete incineration is achieved before the waste reaches the outlet of the kiln. This applies particularly to long rotary kilns where firing from the inlet end of the kiln cannot be applied due to the temperature here being inadequate for complete incineration to be achieved.

Several examples of methods and apparatus for burning solid waste in rotary kilns are known from the patent literature.

The U.S. Pat. No. 4,850,200 indicates a method for firing solid waste through the shell of the rotary kiln via a sluicing arrangement. The U.S. Pat. No. 4,984,983 further mentions the possibility of introducing waste through the kiln shell, mentioning also an ejector being capable of injecting the waste items into the kiln.

The aforementioned methods and apparatus involve a number of disadvantages. For one thing, the mechanical construction of the sluicing arrangement is very complicated, and that part of its feed pipe which is lying within the kiln shell is subjected to substantial mechanical and thermal impacts, and this may reduce the service life of the equipment.

SUMMARY OF THE INVENTION

It is the object of the present invention to provide a method and an apparatus for introducing and incinerating solid waste by means of which the aforementioned disadvantages are remedied.

This is achieved by means of a method of the kind described in the introduction, and being characterized in that the waste is introduced into the outlet casing (kiln hood) of the rotary kiln, and remains here until a substantial, complete incineration has been achieved by contact with the hot airstream flowing through the outlet casing.

Hereby the apparatus as well as the method for introducing and incinerating the waste are simplified, since the waste is introduced through a stationary wall, without any need to inject or shoot the waste into the rotary kiln.

The adequate retention time of the waste in the outlet casing of the rotary kiln is achieved by means of special mechanisms which support and retain the waste in the outlet casing until complete incineration has been achieved. For example, this may be achieved by introducing the waste in such a manner that it rests on the burner pipe of the rotary kiln during the incineration.

Alternatively, the waste may be deposited, especially where the waste consists of automobile tires, around a substantially horizontal pipe, one end of which is led through the kiln outlet casing and pushing the waste along said pipe, which hereby supports and retains the waste during the incineration. By another alternative, the waste may be introduced on a number of shelves being placed in the kiln outlet casing and being preferably provided with a horizontal surface, and pushing the waste forward on said shelves, which hereby support the waste during the incineration.

If the burner pipe of the rotary kiln is used for introducing and supporting the waste, it is preferred that the burner pipe, over at least some of its length, is formed with a flat or troughed upper side for improved supporting of the waste. It is further preferred that the burner pipe is provided with a number of grooves in the surface so as to ensure improved air supply during the incineration, and that the burner pipe is provided with a projection at the end of the burner pipe to assure that any unburned, residual waste drops down to one of the sides of the pipe prior to reaching the nozzle of the burner pipe.

If a horizontal pipe is used for introducing and supporting the waste, it is preferred that said pipe is cooled by means of a liquid or a gas, that the pipe is led crosswise through the kiln outlet casing, and that any non-combustible waste items, such as steel reinforcements from automobile tires, are retained on the pipe until being discharged through the wall of the outlet casing.

If a number of shelves are used for introducing and supporting the waste, it is preferred that the shelves are provided with a number of grooves in the surface in order to improve the air supply for the incineration.

With regard to certain embodiments of the apparatus according to the invention it is preferred that the shelves are placed at a corner of the casing so that the waste can be introduced in the longitudinal direction of the shelves, that the kiln outlet casing is equipped with one or several openings, through which any unburned, residual waste can be extracted, and that the shelves slope downwardly towards the wall of the kiln outlet casing.

BRIEF DESCRIPTION OF THE DRAWINGS

The invention will now be described in further details with reference to the accompanying drawing, being diagrammatical and where.

The indicated reference numbers have the same meaning on all drawings.

DETAILED DESCRIPTION OF THE INVENTION

Figure 1:
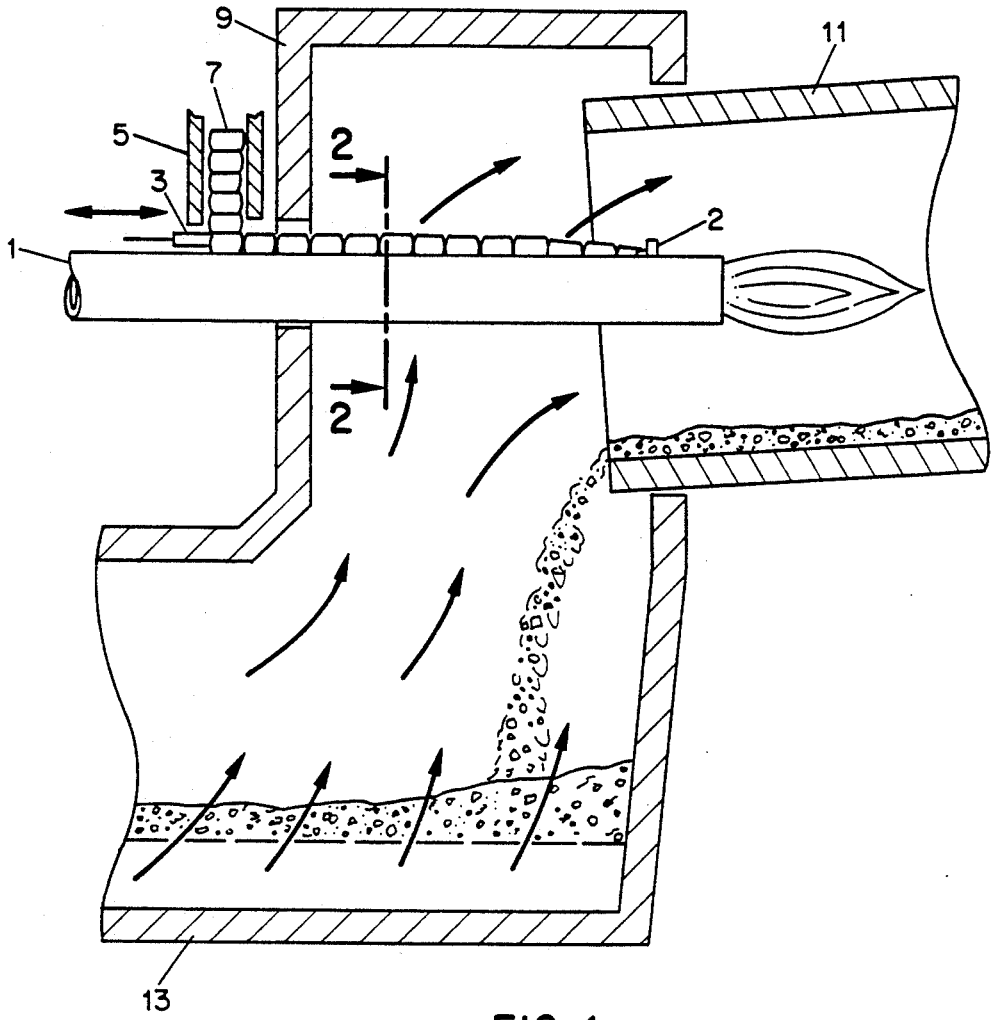
FIG. 1 is a longitudinal section through a first embodiment of an apparatus for carrying out the method according to the invention, where the upper side of a burner pipe is used for introducing and supporting the waste.

FIG. 1 depicts a sectional view of the outlet part of a rotary kiln 11, for example a kiln for burning cement clinker, an outlet casing 9 and a grate cooler 13, all of which elements are of a generally known design.

For carrying out the method according to the invention, the waste items 7 are placed in a shaft or feed hopper 5 from which the waste, while deposited on the burner pipe 1 and by means of a pushing device 3, is pushed into the chamber which is surrounded by the outlet casing 9, where the waste is ignited and burned off under the influence of the hot airstream flowing from the grate cooler 13 towards the rotary kiln 11.

Figure 2:
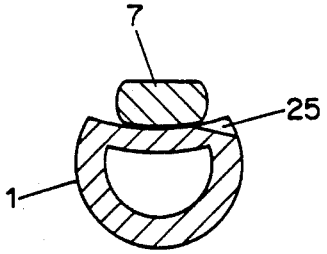
FIG. 2 is a cross-section of the burner pipe in FIG. 1.

As shown in FIG. 2 the cross-section of the burner pipe may have a flat or slightly troughed upper side which may further be equipped with a number of grooves 25 in order to improve the supply of combustion air to the waste. The burner pipe 1 may further be provided with a boss or projection 2 in order to ensure that any unburned, residual waste drops down to one of the sides of the pipe, hence preventing the waste from reaching and disturbing the main flame from the burner pipe 1. The remaining design features of the burner 1 are known.

Figure 3:
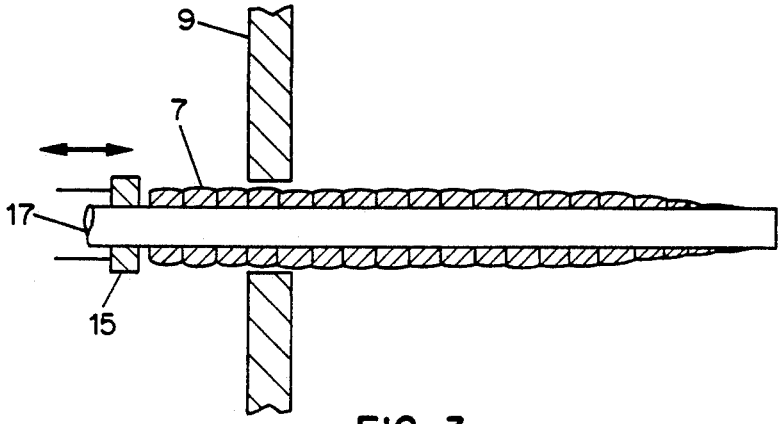
FIG. 3 is a longitudinal section of a second embodiment of an apparatus for carrying out the method according to the invention, where a pipe is used for introducing and supporting the waste.

FIG. 3 shows a second embodiment where the waste objects 7, in the present case preferably automobile tires which are cut at some point on the circumference, are mounted around a pipe 17 which is led through an opening in the kiln outlet casing 9. Inside the pipe 17 there may be one or several pipes for conveying a gaseous or liquid cooling medium, preferably atmospheric air, water or oil. By means of a known pushing device 15 the waste objects can be introduced into the outlet casing 9 where they are burned off.

Figure 3A:
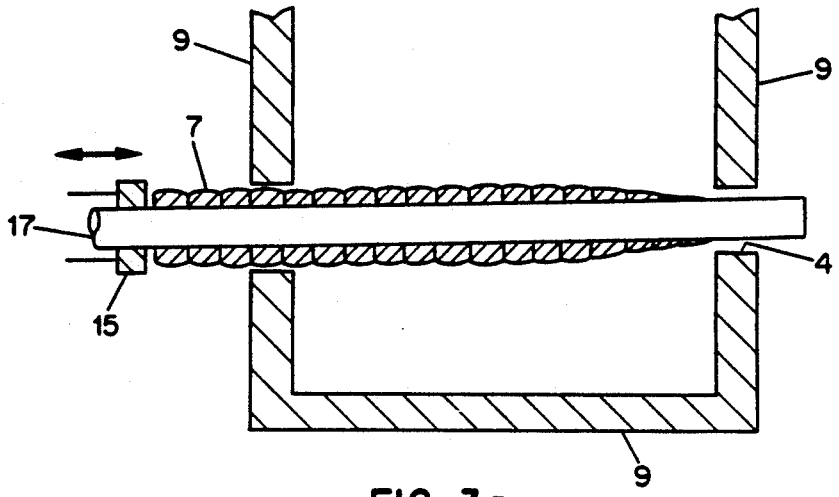
FIG. 3*a* is a top sectional view of a modified embodiment of the apparatus of FIG. 3, wherein the pipe is led crosswise through the kiln.

FIG. 3*a* depicts a modification of the embodiment of FIG. 3 wherein the pipe 17 is led crossways through the kiln outlet casing 9. According to this modification, any non-combustible waste can be passed through the casing and out through an outlet 4.

Figure 4:
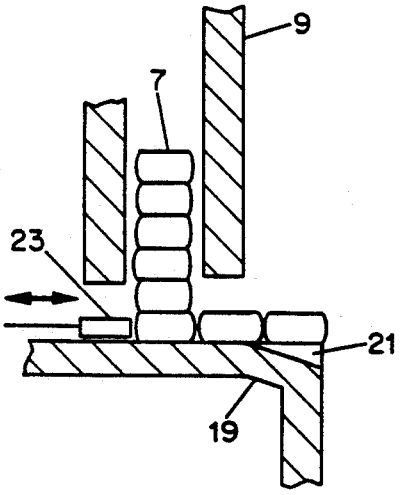
FIG. 4 is a longitudinal section of a third embodiment of an apparatus for carrying out the method according to the invention, where the outlet casing of a rotary kiln is provided with a number of internal shelves on which the waste can be introduced and supported.

FIG. 4 shows a third embodiment where the kiln outlet casing 9 is provided with a horizontal shelf 19 on which the waste objects 7 are introduced by means of a known pushing device 23 and burned off. The shelf may be provided with grooves 21 in order to improve the supply of combustion air.

Figure 6:
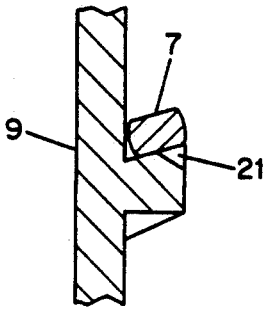
FIG. 6 shows a cross-section of the shelf in FIG. 5.
Figure 5:
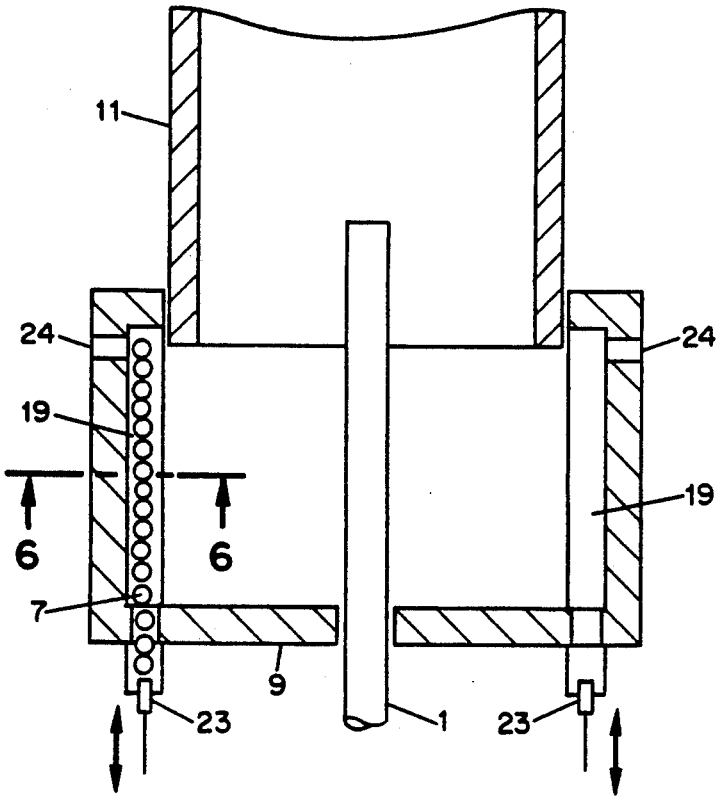
FIG. 5 is a top sectional view of a fourth embodiment of an apparatus for carrying out the method according to the invention, where the outlet casing of a rotary kiln is provided with a number of internal shelves on which the waste can be introduced and supported.

FIGS. 5 and 6 show a fourth embodiment where a shelf 19, in the present case substantially sloping towards the inner wall of the kiln outlet casing 9, is fitted in such a manner that the waste objects can be introduced in the longitudinal direction of the shelf parallel to the wall of the outlet casing 9. The outlet casing may be provided with an opening 24 at the opposite end of the shelf for extraction of any unburned, residual waste, and the shelf 19 may be provided with grooves 21 in order to improve the supply of combustion air.

We claim:

1. A method for introducing and incinerating solid combustible waste objects, such as automobile tires, in a rotary kiln having an outlet casing, a burner pipe within said casing, and a cooling grate positioned such that a hot airstream flows from said cooling grate through said casing and into the kiln, characterized in that the waste is introduced into the outlet casing of the rotary kiln and remains in said casing until a substantially complete incineration has been achieved by contact with the hot airstream flowing through the outlet casing.

2. A method according to claim 1, characterized in that the waste is introduced in such a manner that it rests on the burner pipe of the rotary kiln during the incineration.

3. A method according to claim 1, characterized in that the waste objects are deposited around a substantially horizontal pipe, one end of which is led through the kiln outlet casing, and pushed along said pipe, which thereby supports and retains the waste during the incineration.

4. A method according to claim 3, characterized in that the pipe is cooled by means of a liquid or a gas.

5. A method according to claim 1, characterized in that the waste is introduced on at least one substantially horizontal shelf, being placed in the kiln outlet casing, and that the waste is pushed forward on said shelf, which thereby supports the waste during the incineration.

6. An apparatus for introducing and incinerating combustible waste objects comprising a rotary kiln having an outlet casing, a burner pipe within said casing, and a cooling grate positioned such that a hot airstream flows from said cooling grate through said casing and into the kiln, characterized in that said kiln includes supporting means for supporting said waste objects in the outlet casing such that said objects are incinerated in said hot airstream, and introducing means for introducing said waste objects into the outlet casing and onto said supporting means.

7. An apparatus according to claim 6, wherein said supporting means is the burner pipe.

8. An apparatus according to claim 7, characterized in that the burner pipe is formed, over at least some of its length, with a flat or troughed upper side for improved supporting of the waste objects.

9. An apparatus according to claim 7 or 8, characterized in that the burner pipe is provided with a number of grooves in the surface to improve the air supply to the waste.

10. An apparatus according to claim 7 or 8, characterized in that the burner pipe is provided with a projection to assure that any unburned, residual waste drops down to one of the sides of the pipe prior to reaching the nozzle of the burner pipe.

11. An apparatus according to claim 9, characterized in that the burner pipe is provided with a projection to assure that any unburned, residual waste drops down to one of the sides of the pipe prior to reaching the nozzle of the burner pipe.

12. An apparatus according to claim 6, wherein said supporting means is at least one substantially horizontal pipe one end of which is led through the kiln outlet casing, and around which the waste objects may be hung and supported, and wherein the introducing means includes means for pushing the objects into the kiln and along the pipe as the objects are incinerated in the outlet casing.

13. An apparatus according to claim 12, characterized in that the pipe is led crosswise through the kiln outlet casing such that any non-combustible waste items are passed out of the casing through an outlet in the casing.

14. An apparatus according to claim 6, wherein the supporting means is at least one substantially horizontal shelf, and wherein the introducing means includes means for pushing the objects into the kiln and along the shelf as the objects are incinerated in the outlet casing.

15. An apparatus according to claim 14, characterized in that the shelf is provided with a number of grooves in the surface for improving the air supply to said objects.

16. An apparatus according to claim 14, characterized in that the shelf is placed in a corner of the casing so that the waste can be introduced in the longitudinal direction of the shelf.

17. An apparatus according to claim 16, characterized in that the kiln outlet casing is equipped with one or more openings through which any unburned, residual waste can be extracted.

18. An apparatus according to claim 16 or 17, characterized in that the shelf slopes downwardly towards the wall of the kiln outlet casing the direction perpendicular to the longitudinal of the shelf.

* * * * *